US009272176B1

(12) United States Patent
Bendror et al.

(10) Patent No.: US 9,272,176 B1
(45) Date of Patent: Mar. 1, 2016

(54) MULTI-USE APPARATUS FOR EXERCISING THE SHOULDER, UPPER AND LOWER EXTREMITIES

(71) Applicants: Jack Bendror, Sands Point, NY (US); Zelik Ziegelbaum, Sands Point, NY (US)

(72) Inventors: Jack Bendror, Sands Point, NY (US); Zelik Ziegelbaum, Sands Point, NY (US)

( * ) Notice: Subject to any disclaimer, the term of this patent is extended or adjusted under 35 U.S.C. 154(b) by 0 days.

(21) Appl. No.: 14/519,654

(22) Filed: Oct. 21, 2014

Related U.S. Application Data

(60) Provisional application No. 61/894,524, filed on Oct. 23, 2013.

(51) Int. Cl.
*A63B 21/015* (2006.01)
*A63B 21/16* (2006.01)

(52) U.S. Cl.
CPC ..... *A63B 21/015* (2013.01); *A63B 21/16* (2013.01)

(58) Field of Classification Search
CPC ..... A63B 21/015; A63B 21/00069; A63B 23/12; A63B 21/0615; A63B 21/1484; A63B 2210/50; A63B 23/03575; A63B 21/0552; A63B 2208/0204; A63B 23/085; A63B 22/0605; A63B 23/03508
USPC ..... 482/98, 114–121; 601/23
See application file for complete search history.

(56) References Cited

U.S. PATENT DOCUMENTS

| | | | | | |
|---|---|---|---|---|---|
| 2,530,921 | A * | 11/1950 | Tougas | 482/119 |
| 2,777,439 | A * | 1/1957 | Tuttle | 601/27 |
| 2,921,791 | A * | 1/1960 | Berne | 482/118 |
| 3,013,799 | A * | 12/1961 | Wise | 482/118 |
| 3,647,210 | A * | 3/1972 | Ratcliffe | 482/119 |
| 4,337,050 | A * | 6/1982 | Engalitcheff, Jr. | 434/260 |
| 4,471,957 | A * | 9/1984 | Engalitcheff, Jr. | 482/5 |
| 4,772,015 | A * | 9/1988 | Carlson et al. | 482/92 |
| 5,031,912 | A * | 7/1991 | Vaughn et al. | 482/118 |
| 5,062,633 | A * | 11/1991 | Engel et al. | 482/118 |
| 5,080,350 | A * | 1/1992 | Schofield et al. | 482/132 |
| 5,178,598 | A * | 1/1993 | Finch | 482/118 |
| 5,540,641 | A * | 7/1996 | Williams et al. | 482/114 |
| 5,713,370 | A * | 2/1998 | Cook | 600/595 |
| 2005/0143227 | A1* | 6/2005 | Krietzman | 482/92 |
| 2005/0233875 | A1* | 10/2005 | Clarke et al. | 482/123 |
| 2008/0081745 | A1* | 4/2008 | Sargen et al. | 482/98 |
| 2009/0111660 | A1* | 4/2009 | Snow et al. | 482/38 |
| 2013/0023390 | A1* | 1/2013 | Ree | 482/124 |

* cited by examiner

*Primary Examiner* — Loan H Thanh
*Assistant Examiner* — Andrew S Lo
(74) *Attorney, Agent, or Firm* — Gottlieb, Rackman & Reisman, P.C.

(57) ABSTRACT

A multi-use exercise apparatus consisting of two stations, a wheel as the upper station for exercising upper extremities and a T-bar below the wheel as the lower station designed for resistance exercises of the lower extremities. Both stations are mounted on a collapsible structure making it easily transportable. Fixed knobs are disposed at various radii from an axis of the wheel to allow users to perform different ROM type exercises. Anchoring means are also provided on the apparatus to engage various other exercising accessories as well, either on the T-bar or adjacent to the wheel.

12 Claims, 6 Drawing Sheets

MULTI-USE APPARATUS FOR EXERCISING THE SHOULDER, UPPER AND LOWER EXTREMITIES

RELATED APPLICATIONS

This application claims priority to U.S. Provisional application Ser. No. 61/894,524 filed on Oct. 23, 2013 and incorporated herein by reference in its entirety.

BACKGROUND OF THE INVENTION

1. Field of Invention

The present invention relates to the field of rehabilitation and exercise equipment. This apparatus allows the user to exercise various muscle groups of the upper and lower extremities as well as the core musculature. This apparatus is user friendly because of its simplicity and compact design.

More particularly, this invention pertains to an exercising apparatus configured for a plurality of exercises ranging from the upper body to the lower extremities, and more particularly, to an exercising apparatus having an upright main section with a vertical wheel rotatable about a horizontal axis, a variable resistance mechanism controlling a resistive force to the rotation of the wheel, and a plurality of grasping members disposed at various radii from the wheel's center of rotation.

2. Description of the Prior Art

With a sizeable aging population, as well as a rising number of car and industrial injuries, the necessity for physical therapy and rehabilitation has risen. Numerous machines and modalities play an important role in the recovery process as part of physical therapy. The multi-use exercise apparatus described here is designed and constructed to aid patients' recovery.

Exercising machines used often in physical therapy include devices having a wheel and a resistive mechanism that resists rotation of the wheel. These machines are used to increase ROM (Range of Motion), muscle strength and endurance in the upper extremities of a person. There are numerous shoulder wheels on the market such as Bailey, Housman, Clinton and others. Each of these devices, some motor driven, is unnecessarily complicated in both their construction and use. Moreover, shoulder exercise wheels are designed to accomplish either muscle strengthening or ROM. The apparatus in this invention is able to accomplish both goals and allow a person to perform many other exercises as well.

SUMMARY OF THE INVENTION

It is the intention of this applicant to use the ubiquitous commercially available shoulder wheel and reinvent it to become a multi-use piece of exercise equipment. The user can perform a wide range of exercises for various muscle groups that would otherwise require a variety of different independent apparatus, some of which would be bulky and relatively heavy and intended for use in locations occupying a large space. Being collapsible and easily transportable, the apparatus in this invention occupies little space.

It should be noted that while in the present application, the subject invention is described in conjunction with physical therapy for patients, the invention is equally useable by a healthy person wishing to strengthen some specific set of muscles or increase the ROM for some muscle for some other reason.

The present invention overcomes the drawbacks of known multi-use exercise devices and for the first time provides an apparatus for exercising the entire body within a short period of time and a small area. In accordance with the present invention, applicant provides exercise apparatus comprising of two stations namely, a wheel and a T-Bar for exercising different muscle groups of the body, to achieve a full body exercise. The two stations are mounted on a frame that is collapsible so as to become easily portable for use in different areas of the facility and for exhibition at shows. The wheel station of the exerciser is comprised of a multiple spoke circular wheel somewhat similar to the shape of a conventional sailboat steering wheel. Under the wheel and rigidly attached to its frame is the T-Bar station of the exerciser that ends a few inches off the ground.

The T-Bar allows one to strengthen all major muscle groups of the lower body. The multi-use apparatus in this invention is a compact exercise device that could be used in hospitals, rehab centers, private offices and in homes.

DETAILED DESCRIPTION OF THE INVENTION

Figure 1:
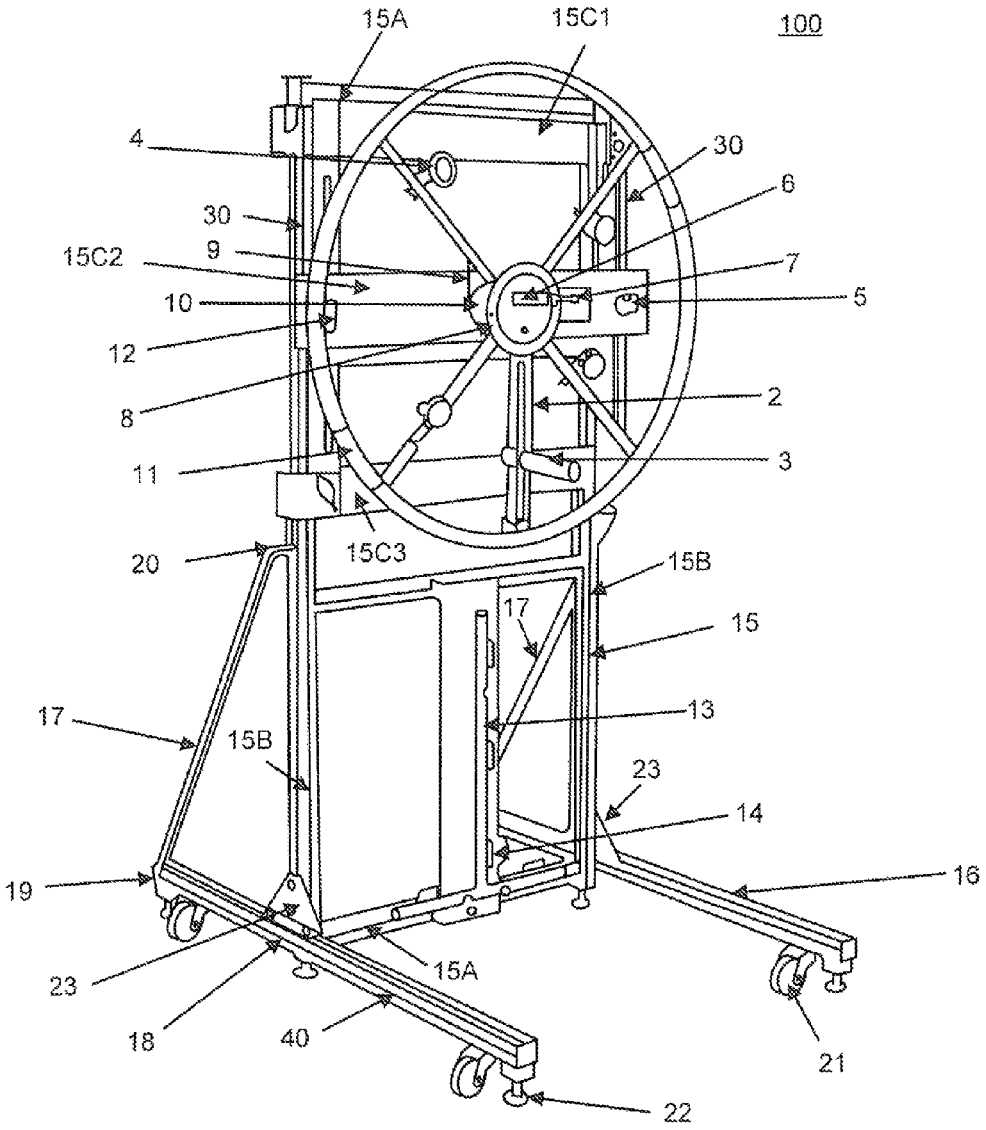
FIG. 1 shows a side orthogonal view of an apparatus constructed in accordance with this invention.

Referring now to FIG. 1, an apparatus 100 constructed in accordance with this invention includes a frame 15 supporting a rotatable wheel 1. In one embodiment, the frame 15 is secured to the floor or a wall relatively permanently. In another embodiment, the frame 15 is pivotably attached to a base 40 at pivot point 18. In use, stabilizing bars 17 and rigidizing brackets 23 are provided to insure that the frame maintains its upright position solidly without any twists, or shakes.

The frame 15 is formed of a plurality of horizontal bars 15A and two vertical bars 15B. Two vertical channels 30 extend between the two upper horizontal bars 15A, adjacent to bars 15B and provide rails for three wood strips 15C1, 15C2,15C3. Preferably wood strip 15C2 can be moved up and down on channels 30 using conventional means. Once a position for strip 15C2 is selected, the strip is locked into position with respect to the channels 30 and the frame 15 by height adjusting knob 5 in a conventional manner. The strip 15C2 is used to mount wheel 1 and various other accessories as discussed in more detail below.

The lower horizontal bars 15A are used to mount a vertical wood strip 15D. The strip 15D is permanently mounted on the bars 15A and supports a T-Bar 13.

The wheel is supported and mounted by a calibrated variable resistance mechanism (6) controlled by a knob (7). The resistance mechanism 6 is configured to resist and control the movement of the wheel as per the user's requirement, using knob 7. The mechanism includes an internal drum (not shown) with brake shoe linings controllable by a calibrated scale from zero to maximum making it more sensitive to motion. A 360° scale (8) is provided on the drum to measure and record the degree of revolution from either direction while a user/patient is exercising. Rods 2 are extending vertically from the hub of wheel 1 to the perimeter of wheel 1. The rods 2 have markings defining a graduated scale. A ROM grip handle 3 is slidably mounted on rods 2 and is movable along rods 2 in a conventional manner and can be secured at any of the markings of the graduated scale. The markings on the graduated scale provide a quantitative measurement of the exercises and the capability of a particular patient using the apparatus 100 regarding his/her range of motion.

Figure 1A:
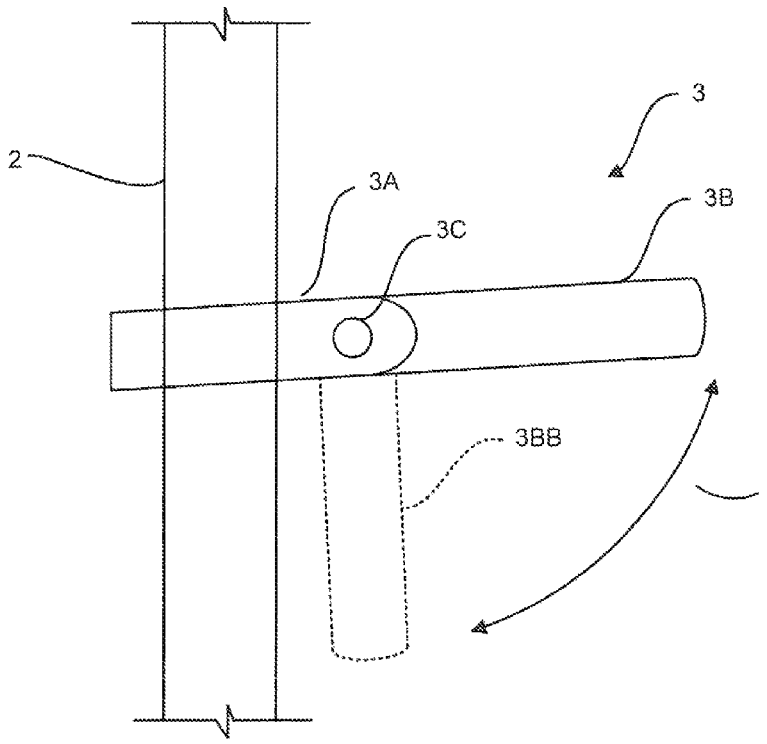
FIG. 1A shows somewhat diagrammatically a side view of the ROM grip handle.

Importantly, in accordance with this invention, the ROM grip handle 3 can also be pivoted from an active position, in which the handle extends essentially horizontally so that it can be grabbed and used by a user/patient, to an essentially inactive position in which the handle 3 is extending vertically in an inactive position. For example, as shown in FIG. 1A, the handle 3 can be supported on the rods by a sleeve 3A. The handle 3 includes an extension 3B connected to the sleeve 3A by a hinge 3C. In the active configuration, the handle 3 has its extension disposed horizontally so that it can be grabbed by hand. The extension can be selectively pivoted downwardly as at 3BB for the inactive position as indicated by arrow XX.

Figure 1B:
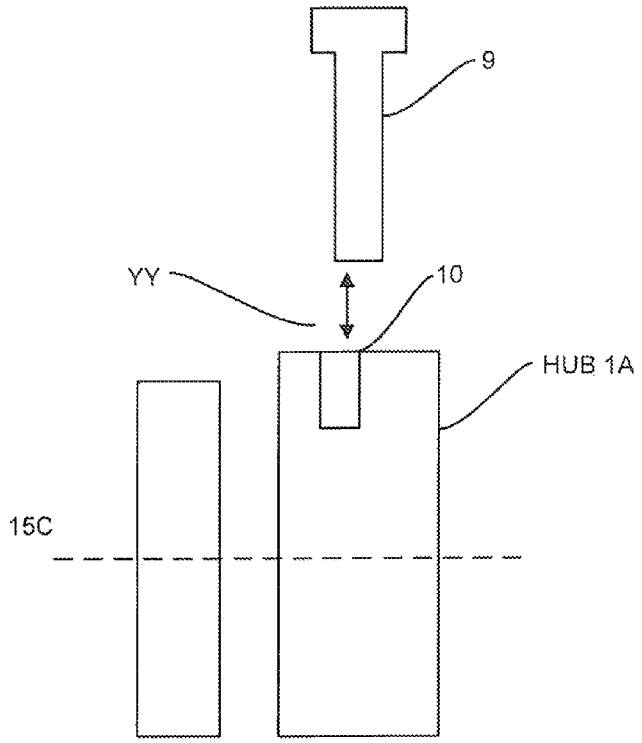
FIG. 1B shows a pin being used to temporarily immobilize the wheel.

The resistance mechanism 6, with its brake shoe linings (not shown), can control the force of torque resistance; from zero to a maximum to reach a point where the wheel cannot be easily turned anymore. In spite of this, the wheel 1 is not positively locked to the point of being safe enough for the user/patient to use as an exercise bar or other purposes. This invention has a type of a "dead bolt" design in the form of a wheel locking pin (9) chained to the frame which can be engaged into a hole (10) in the hub 1A of the wheel 1 for maximum safety for the user, as shown in FIG. 1B. The patient can now get hold of wheel grippers (11) and perform various exercises of the lower extremities without fear of having the wheel turn inadvertently.

As previously discussed, handle 3 can be positioned at different radii along rods 2 for different ROM arcs. Thus, for user/patients with severe shoulder issues, the calibrated scale on rods 2 is used for precise measurements of progress of the user/patient. The therapist must adjust the ROM arc for the needs of different users/patients. However, clinical experience has demonstrated that a few discrete arcs are more than sufficient for most users/patients. This invention has an additional feature whereby preferably colored and/or numbered knobs (4) are mounted on each spoke of the disclosed wheel. The knobs 4 are mounted at discrete radii that determine the ROM arc. Each knob 4 is preferably spherical and has the size of a billiard ball, although knobs of different shapes and sizes may be used as well. Using this easier-to-grip knob 4 as a handle, instead of the commonly used handle (3), and without any adjustments, it frees the therapist for other duties as he/she simply directs the user/patient which knob to use. The knob 4 requiring the least amount of effort is mounted on the perimeter of the wheel and the others, as the radius of the arc is reduced, requiring increased effort. Of course, as discussed above, when the knob 4 is used, handle 3 is folded to an inactive position 3BB, shown in FIG. 1A.

The wheel 1 and the T-Bar 13 are provided with a plurality of hooks 12, 14. The hooks are used to engage one or more flexible elements such as a THERA-BAND® type bands, a bungee cords or resistance tubes that are normally lined up on a wall. This limits the angles from which a user/patient can perform various exercises. In this invention, U-hooks (12) are equally spaced around the circumference and under the rim of the wheel so that a flexible element can be hooked at different angles for the user/patient to perform exercises while standing or sitting.

On the vertical and horizontal portions of the T-Bar 13 are hooks (14) which are used to receive the flexible elements which are then connected to a user's/patient's strapped legs. With the wheel securely locked and the user/patient holding onto grippers (11) on the wheel, he/she can perform various lower limbs exercises.

As indicated before, the wheel (1) and the T-Bar (13) are mounted on frame 15 that is made of several bars. The bars can be aluminum profiles, or can be made from other materials.

Base 30 is made of two outriggers 16. The outriggers, which are also aluminum profiles, have lateral slots that receive pivots 18. The stabilizing bar (17) connects the outriggers (16) to the frame 15 via pivots (19) and (20). Upon loosening pivots (18), (19) and (20), the frame 15 can be folded over the base and the outriggers 16 can then be slid into slots of bars 15B to collapse the whole assembly into a small compact configuration as shown in FIG. 2A. The rigidizing bracket 23 is not an integral part of the collapsible structure. It is added later when the structure 100 is placed in a fixed location for extensive use. The stabilizing bars 17 are part of the structure and need not be removed.

Mounted onto the outriggers (16) are four casters (21) used for easy transport of the apparatus. Mounted under the frame (15) and the outriggers (16) are adjustable leveling feet (22) to raise the structure off the casters (21) and thus stabilize the structure. The collapsed apparatus, as is, can be used for demonstration purposes while exhibiting at shows. However, for permanent use in fixed locations, two rigidizing brackets (23) are added to join the frame (15) to the outriggers (16) and thus strengthen the structure further.

Figure 2C:
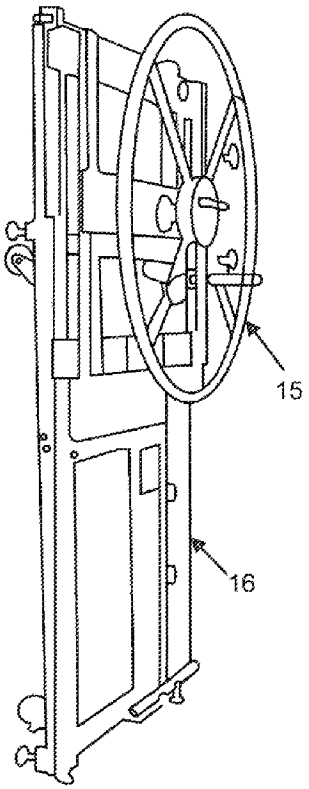
FIGS. 2A-2C show the apparatus in a fully collapsed, partially collapsed and open configuration, respectively.
Figure 2B:
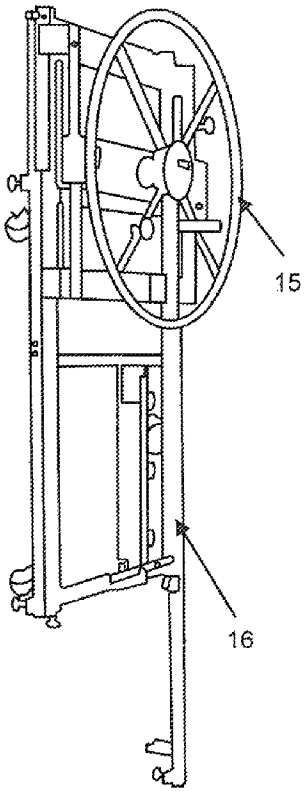
Figure 2A:
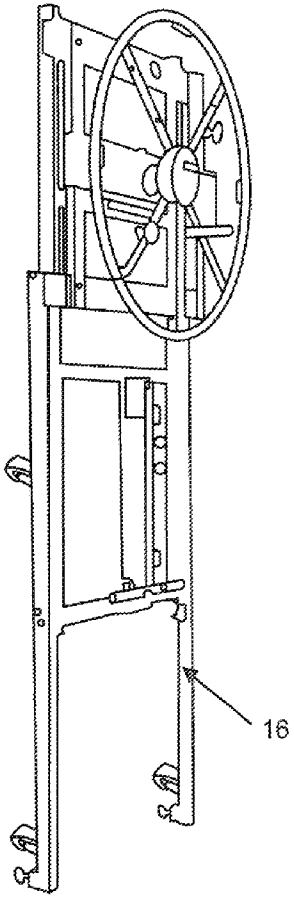
Figure 3A:
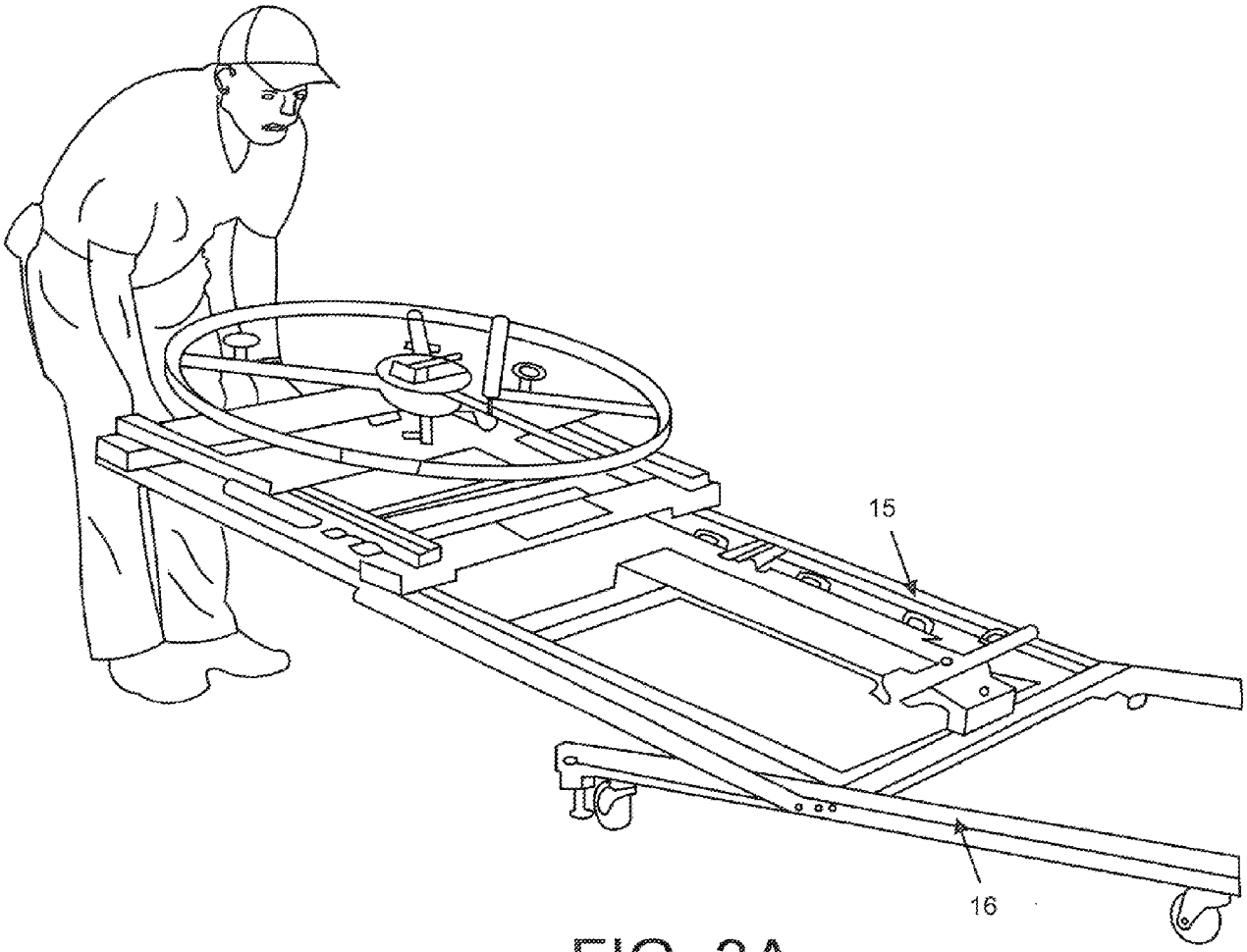
FIG. 3A shows the frame being partially raised over the base.
Figure 3B:
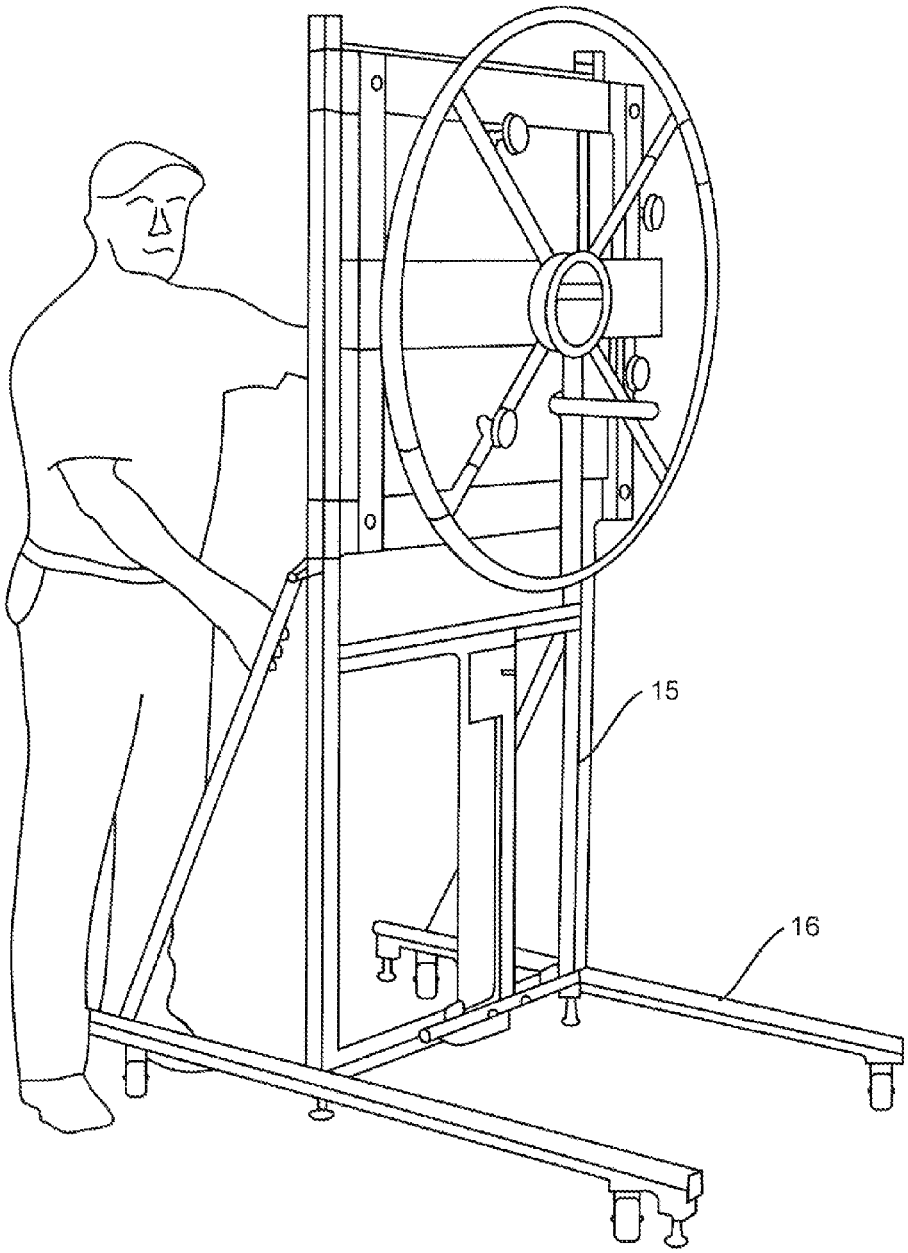
FIG. 3B shows the frame completely raised and secured to the base.

In order to use the apparatus 100, the outriggers 16 are extended or pulled out of the slots of bars 15B, as shown in FIGS. 2B and 2C. The frame 15 is then pivoted upwardly until it reaches an upright orientation, as shown in FIGS. 3A, 3B. Feet 40 may also be provided at the ends of the outriggers 16. These feet can be selectively moved downwardly until they extend past the casters and engage the floor. The feet insure that the apparatus does not move on the casters during exercise.

Numerous modifications may be made to this invention without departing from its scope as defined in the appended claims.

We claim:

1. An exercising apparatus comprising:

a frame;

a resistance mechanism;

a wheel disposed on said frame and rotatable about an axis, the rotation of said wheel being opposed by a resistive force from said resistance mechanism;

a plurality of knobs fixed on said wheel and being disposed at different radial distances from said axis, wherein a user can perform various range of motion exercises by grasping respective different knobs;

a range of motion handle; and a handle support disposed radially on said wheel, said range of motion handle being movable along said handle support.

2. The exercising apparatus of claim 1 wherein said range of motion handle is foldable between an operational position in which said range of motion handle is disposed substantially horizontally parallel to the axis and an inactive position, with said wheel being rotatable by one of said knobs without interference from said range of motion handle.

3. The exercising apparatus of claim 1, wherein said wheel includes a wheel hub with an aperture, said exercising apparatus further including a pin that locks said wheel to block it from rotation with the pin extending into said aperture.

4. The exercising apparatus of claim 1 further comprising a base, said frame being supported on said base.

5. The exercising apparatus of claim 4 further comprising pivots for supporting said frame pivotably on said base between an active position in which said frame is disposed substantially vertically and an inactive position in which said frame is supported horizontally on said base.

6. The exercising apparatus of claim 5 wherein said base includes two outriggers slidable with respect to said frame, said outriggers being selectively positioned to form a compact structure for said apparatus when said apparatus is not in use.

7. A multi-use exercise apparatus that allows a user to perform a plurality of exercises targeting different muscle groups, said apparatus comprising:

a frame;

a resistance mechanism attached to said frame; a wheel supported by said frame and rotatable about a horizontal axis, said resistance mechanism being coupled to said wheel to control and provide a selective resistance to the rotation of said wheel as a user operates said wheel;

a T-Bar attached to said frame and including receiving elements for receiving accessories for exercising the lower extremities of the user;

a plurality of knobs mounted on said wheel at different discrete distance from the horizontal axis, each knob providing a different range of motion (ROM) parameter when grasped and used by the user; and a range of motion grip handle arranged on the wheel and constructed to provide a preselected range of motion when the apparatus is in use, said range of motion grip handle including an extension disposed horizontally, said range of motion grip handle including a hinge for selectively pivoting said extension to a vertical position in which said handle does not interfere with a hand of the motion rotating said wheel using one of said knobs.

8. The exercise apparatus of claim 7 wherein said wheel includes radial spokes, and said knobs are mounted on said spokes.

9. The exercise apparatus of claim 7 wherein said exercise apparatus is mounted to a structure that can be readily collapsed and erected again.

10. A multi-use exercise apparatus that allows a user to perform a plurality of exercises targeting different muscle groups, said apparatus comprising:

a frame;

a resistance mechanism attached to said frame; a wheel supported by said frame and rotatable about a horizontal axis, said resistance mechanism being coupled to said wheel to control and provide a selective resistance to the rotation of said wheel as a user operates said wheel:

a T-Bar attached to said frame and including receiving elements for receiving accessories for exercising lower extremities of the user; and hooks that are equally spaced around a circumference of said wheel so that at least one flexible element can be attached at different angles around said wheel for the user to perform a wide variety of exercises while standing or sitting.

11. A multi-use exercise apparatus that allows a user to perform a plurality of exercises targeting different muscle groups, said apparatus comprising:

a frame;

a resistance mechanism attached to said frame;

a wheel supported by said frame, said wheel having a hub and rotatable about a horizontal axis, said resistance mechanism being coupled to said wheel to control and provide a selective resistance to the rotation of said wheel as a user operates said wheel;

a T-Bar attached to said frame and including receiving elements for receiving accessories for exercising lower extremities of the user; and a pin that provides a wheel lock that prevents rotation of the wheel when engaged into a hole in the hub of the wheel to provide maximum safety to the user who is gripping the wheel using to perform various exercises.

12. The exercise apparatus of claim 11 further comprising hooks on said T-bar are mounted as an extension of the frame for use with exercises of the lower extremities when the user grips the wheel and the user's legs are strapped to at least one flexible member attached to the hooks.

* * * * *